US011927023B2

(12) United States Patent
Krattiger

(10) Patent No.: US 11,927,023 B2
(45) Date of Patent: Mar. 12, 2024

(54) SPACER DEVICE FOR FORMWORK

(71) Applicant: Krattiger SA Holding, Bedano (CH)

(72) Inventor: Andreas Krattiger, Dino (CH)

(73) Assignee: Krattiger SA Holding, Bedano (CH)

( * ) Notice: Subject to any disclaimer, the term of this patent is extended or adjusted under 35 U.S.C. 154(b) by 77 days.

(21) Appl. No.: 17/687,304

(22) Filed: Mar. 4, 2022

(65) Prior Publication Data

US 2022/0282504 A1 Sep. 8, 2022

(30) Foreign Application Priority Data

Mar. 8, 2021 (CH) ..... 00245/21
Mar. 8, 2021 (IT) ..... 102021000005309

(51) Int. Cl.
*E04G 17/06* (2006.01)
*E04G 17/065* (2006.01)

(52) U.S. Cl.
CPC ..... *E04G 17/0658* (2013.01)

(58) Field of Classification Search
CPC . E04G 17/0658; E04G 17/0652; E04G 17/06; E04G 17/0657; E04G 17/0714; E04G 17/0735; E04G 17/0752; E04G 17/0757
USPC ..... 249/43, 213, 216
See application file for complete search history.

(56) References Cited

U.S. PATENT DOCUMENTS 842,722 A * 1/1907 Swinnerton ..... E04G 17/0714 249/43
1,767,834 A * 6/1930 Carlson ..... E04G 17/0752 249/43
1,907,618 A * 5/1933 Umbach ..... E04G 17/0752 249/43
2,411,678 A * 11/1946 Cornella ..... E04G 17/0652 249/217
3,400,182 A * 9/1968 Kolt ..... B62D 27/026 264/46.7
3,927,856 A * 12/1975 Lovisa ..... E04G 17/0714 249/177
4,159,099 A * 6/1979 Maguire ..... E04G 15/061 249/43
4,625,940 A * 12/1986 Barton ..... E04G 15/061 249/43
5,405,119 A * 4/1995 Maguire ..... E04G 15/06 249/43

(Continued)

FOREIGN PATENT DOCUMENTS

DE 102014211483 A1 12/2015
EP 3088633 A1 11/2016
WO 2018137728 A1 8/2018

*Primary Examiner* — Beth A Stephan
(74) *Attorney, Agent, or Firm* — Hinckley Allen & Snyder; Stephen Holmes

(57) ABSTRACT

A spacer device (10) for formwork, comprising a hollow tubular body (2) extending around a longitudinal axis (X-X) is described, said tubular body (2) being configured to house a cross tie rod (7) and comprising: two side tubular portions (2*a*,2*b*); each side tubular portion (2*a*,2*b*) comprising fastening means at one end; and at the remaining end, a tapered portion (3*a*,3*b*) configured to rest on the wall of the formwork; characterised by comprising a ball joint (5*a*,5*b*) interposed between each tapered portion (3*a*,3*b*) and the respective side tubular portion (2*a*,2*b*) to couple each tapered portion (3*a*,3*b*) with the respective side tubular portion (2*a*,2*b*).

16 Claims, 2 Drawing Sheets

(56) References Cited

U.S. PATENT DOCUMENTS

| | | | | |
|---|---|---|---|---|
| 5,497,592 | A * | 3/1996 | Boeshart | E04G 17/0654 249/43 |
| 5,813,185 | A * | 9/1998 | Jackson | E04G 17/0657 52/405.1 |
| 10,267,051 | B2 * | 4/2019 | Elduayen Madariaga | E04G 17/0655 |
| 2008/0035832 | A1 * | 2/2008 | Belanger | E04G 17/14 249/189 |

* cited by examiner

SPACER DEVICE FOR FORMWORK

FIELD OF THE INVENTION

The present invention refers to the field of construction equipment and in particular to a device for making concrete walls. More particularly, the present invention concerns a spacer device for formwork.

KNOWN ART

As known, shuttering or formwork are devices normally used in construction for making concrete works. In detail, the concrete walls are made by forming a gap between two formwork panels arranged so that they face each other. The panels are typically constrained to each other by means of cross tie rods. Each panel having an inner wall and an outer wall, the inner wall being the one intended to contact the concrete.

Once the panels are fastened to each other, the concrete is poured into the gap that is formed between the formwork panels.

To prevent the concrete from adhering to the cross tie rods once it has solidified, the latter are positioned beforehand inside a tubular element. Once the concrete has solidified, the formwork panels and cross tie rods are removed. Vice versa, the removal of the tubular element is optional.

U.S. Pat. No. 5,813,185 describes a housing for cylindrical tube and therein a cross tie rod transverse to the formwork which is used to fasten two formwork panels arranged parallel to each other.

A conical end is removably coupled to each end of the tube.

EP3088633 describes a formwork tube comprising a cylindrical central portion and two conical ends arranged at each end of the central portion. The central portion is divided into two segments, in such a way that the formwork tube can be separated into two portions, a first portion formed by a segment and one of the conical ends, and a second portion formed by the remaining segment and the remaining conical end. The formwork tube is adapted to house therein a cross tie rod transverse to the formwork.

The Applicant has observed that in the case of vertical non-alignment of the walls of the formwork, in particular of the holes adapted to receive the cross tie rod, there is a loss of adherence of the conical end of the tube with respect to the same wall of the formwork, due to its inclination with respect to the wall.

The inclination of the conical end with respect to the wall of the formwork and the consequent loss of adherence result, during the casting of the concrete, in the possibility of accessing the grout (compound of water and still liquid cement) inside the tube.

As the grout enters the tube, it solidifies, making it essentially impossible to remove the cross tie rod from the formed wall.

The Applicant has also observed that in the case that the walls of the formwork are not perfectly parallel but slightly inclined with respect to each other, there is a loss of adherence of the conical end of the tube with respect to the same wall of the formwork, due to its inclination with respect to the latter.

Therefore, the Applicant also raised the problem of making a spacer device for formwork which allows to overcome the problems of known formwork tubes.

More particularly, the Applicant raised the problem of making a spacer device for formwork that would allow its conical ends to remain adherent to the inner walls of the formwork even in case of slight misalignments and/or mutual inclinations of the same walls.

SUMMARY OF THE INVENTION

Therefore, the invention, in a first aspect thereof, relates to a spacer device for formwork of the type comprising two formwork panels arranged so that they face each other; each panel having an inner wall and an outer wall, the inner wall being the one intended to contact the concrete, said device comprising a hollow tubular body extending around a longitudinal axis, said tubular body being configured to house a cross tie rod and comprising:

two side tubular portions and a central tubular portion; each side tubular portion being opposite the remainder with respect to the central tubular portion; each side tubular portion comprising, at one end, fastening means for the fastening to said central tubular portion so as to removably couple said side tubular portion to said central tubular portion; and at the remaining end, a tapered portion configured to rest on the inner wall of the formwork panel; characterised by comprising a ball joint interposed between each tapered portion and the respective side tubular portion to couple each tapered portion with the respective side tubular portion.

The present invention, in the aforesaid aspect, may have at least one of the preferred features described below.

Preferably, each ball joint comprises a first curvilinear surface arranged at one end of said side tubular portion and a second curvilinear surface arranged on said tapered portion; said first curvilinear surface having a curvature substantially corresponding to the one of said second curvilinear surface so as to rotatably couple said tapered portion (3*a*,3*b*) with said side tubular portion.

Conveniently, the tubular body comprises a central tubular portion; each side tubular portion being opposite the remainder with respect to the central tubular portion.

Preferably, the fastening means are shaped to removably couple the side tubular portion and the central tubular portion.

Conveniently, the tapered portion comprises a support base adapted to define a lying plane.

Preferably, the ball joint is configured to allow an inclination of the lying plane of less than 45° with respect to a vertical direction.

Advantageously, the fastening means comprise a section-reduced portion arranged at one end of said side tubular portion and a plurality of radially-projecting longitudinal ribs.

Conveniently, the fastening means comprise longitudinal grooves arranged laterally to the longitudinal ribs.

Preferably, the longitudinal rib has a height measured in a radial direction, which varies along its extension.

Advantageously, the side tubular portions have substantially equal extension along the longitudinal axis.

Preferably, each tapered portion is arranged downstream of the ball joint, while each side tubular portion is arranged upstream of said ball joint.

Further characteristics and advantages of the invention will become more apparent from the detailed description of some preferred, but not exclusive, embodiments of a spacer device for formwork according to the present invention.

BRIEF DESCRIPTION OF THE DRAWINGS

Such description will be set forth hereinafter with reference to the appended drawings, provided for indicative, and therefore non-limiting, purpose only, wherein.

DETAILED DESCRIPTION OF EMBODIMENTS OF THE INVENTION

Figure 1:
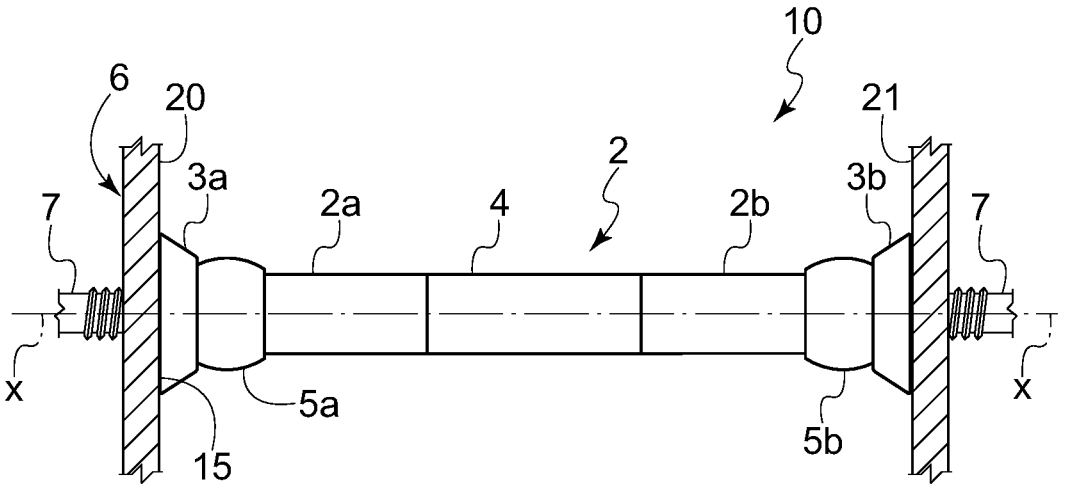
FIG. 1 shows a schematic side view of a spacer device for formwork according to the present invention.

With reference to the figures, a spacer device for formwork according to the present invention is denoted by the reference numeral 10.

The spacer device for formwork 10 of the type comprises two formwork panels arranged so that they face each other; each panel having an inner wall and an outer wall, the inner wall being the one intended to contact the concrete. The spacer device comprises a hollow tubular body 2 extending around a longitudinal axis X-X. The hollow tubular body 2 is shaped to house a cross tie rod 7 transverse to the formwork.

The hollow tubular body 2 comprises at least two side tubular portions 2*a*,2*b* and two tapered portions 3*a* and 3*b*.

Each tapered portion 3*a*,3*b* is arranged at one end of a side tubular portion 2*a*,2*b*.

The tapered portions 3*a* and 3*b* provide a supporting surface for the formwork panel 6 so that the tie rod 7 is correctly supported inside the spacer device 10.

In greater detail, the tapered portions 3*a* and 3*b* are equipped with a supporting surface for the formwork panel 6.

In fact, a correct traction of the tie rod 7 results in a good stability during formwork assembly.

The device 10 according to the present invention is configured to rest on the inner walls 20,21 of the formwork and to distance them, while the anchoring thereof is mainly assigned to other devices known to the person skilled in the art, in particular in the specific case to the tie rods 7.

Each side tubular portion 2*a*,2*b* extends along the longitudinal extension axis X-X.

Preferably, each side tubular portion 2*a*,2*b* extends along its own extension axis coinciding with the spacer device 10 assembled with the longitudinal axis X-X, for a length greater than 7 cm, preferably for a length greater than 10 cm.

Each side tubular portion 2*a*,2*b* extends along its extension axis for a length of less than 20 cm, preferably less than 15 cm.

Preferably, each cylindrical portion 2*a*,2*b* has the same extension along the longitudinal extension axis X-X.

Preferably, each side tubular portion 2*a*,2*b* is tapered in the direction opposite its tapered portion 3*a*,3*b*.

In particular, each side tubular portion 2*a*,2*b* has a slight tapering in the direction opposite its tapered portion 3*a*,3*b*.

At its free end, each side tubular portion 2*a*,2*b* has fastening means 8 configured to couple it to a central tubular portion 4 so as to form a single tubular element 2 extending between the two conical portions 3*a*,3*b*.

The fastening means 8 enable the removable coupling of each side tubular portion 2*a*,2*b* to the central tubular portion 4 and, for this purpose, comprise a reduced section portion 17 of the end of each side tubular portion 2*a*,2*b* and of the longitudinal ribs 9.

The longitudinal ribs 9 are radially projecting and configured to engage elastically the inner surface of the central tubular portion 4.

The longitudinal ribs 9 are arranged angularly spaced along the circumference of the side tubular portion 2*a*,2*b*.

Each longitudinal rib 9 has a height measured in radial direction, which varies along its extension.

In order to provide greater elasticity, each longitudinal rib 9 has two longitudinal cuts 11 of equal extension and arranged laterally on the reduced section portion 17 of the side tubular portion 2*a*,2*b*. The longitudinal cuts 11 are circumferentially opposite with respect to the same longitudinal rib.

Each longitudinal rib 9 extends for at least 1 cm along the axis X-X. Advantageously, each longitudinal rib 9 extends for at least 2 cm along the axis X-X.

At the remaining end, each side tubular portion 2*a*,2*b* comprises a tapered portion 3*a*,3*b* configured to rest on the inner wall 20, 21 of the formwork.

Each tapered portion 3*a*,3*b* is tapered away from the wall of the formwork and comprises a support base 15 adapted to define a lying plane α.

According to a particularly advantageous aspect of the present invention, the spacer device 10 for formwork comprises two ball joints 5*a*,5*b*, each interposed between a tapered portion 3*a*,3*b* and the respective side tubular portion 2*a*,2*b* so as to couple each tapered portion 3*a*,3*b* with the respective side tubular portion 2*a*,2*b*.

Each ball joint 5*a*,5*b* is integral with a side tubular portion 2*a*,2*b* and is placed in contact with the respective tapered portion 3*a*,3*b*.

In the embodiment shown in the figures, each ball joint 5*a*,5*b* is made of a single piece with a side tubular portion 2*a*,2*b*.

Each tapered portion 3*a*,3*b* is arranged downstream of each ball joint 5*a*,5*b* while each side tubular portion 2*a*,2*b* is arranged upstream of the respective ball joint 5*a*,5*b* with respect to the longitudinal extension axis X-X.

Figure 2:
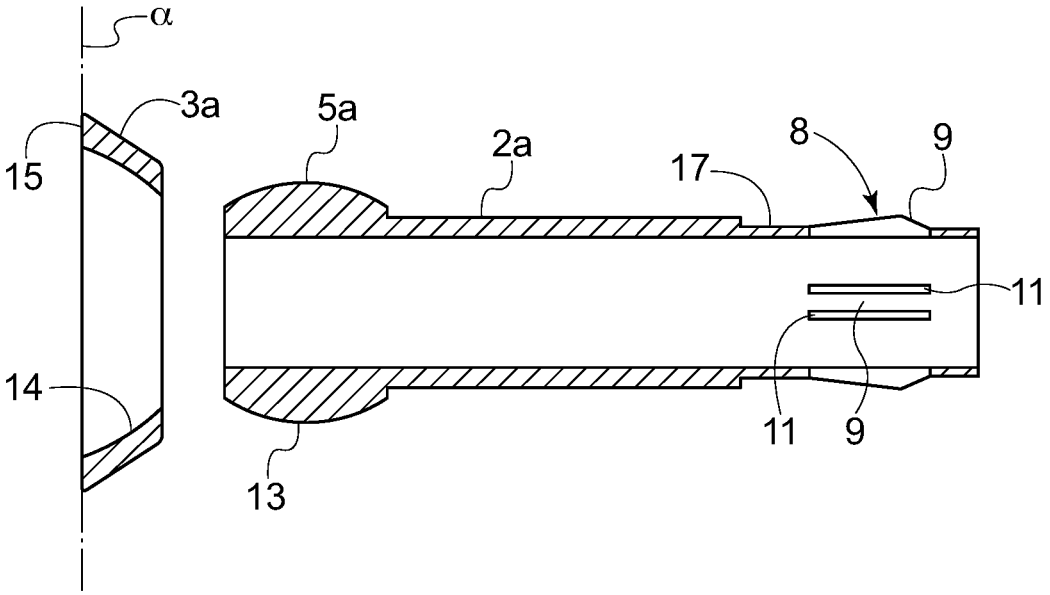
FIG. 2 shows a schematic sectional view of a side tubular portion of the spacer device for formwork of FIG. 1.
Figure 3:
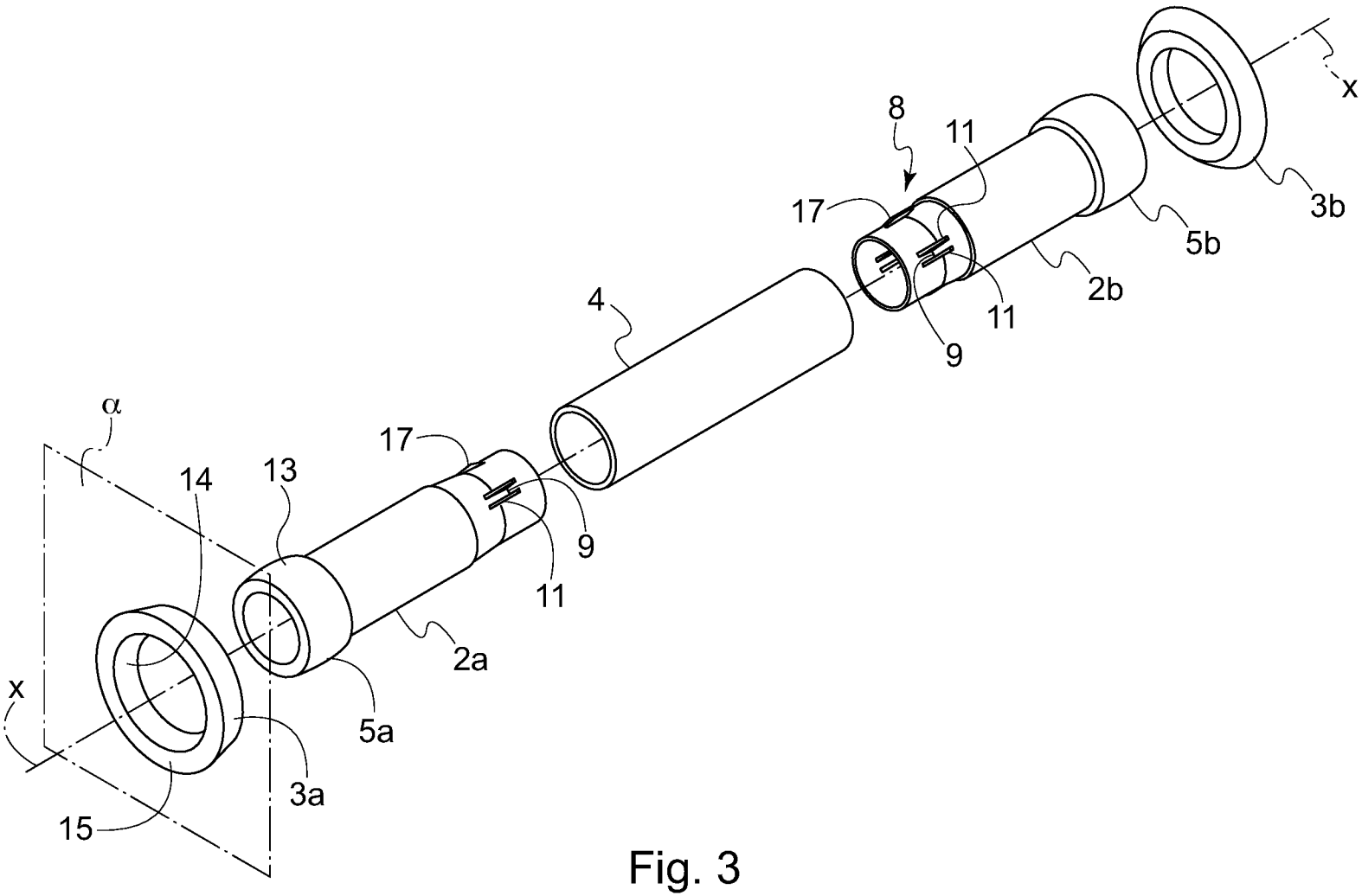
FIG. 3 shows a schematic exploded view of the spacer device for formwork of FIG. 1.

As better shown in FIGS. 2 and 3, each ball joint 5*a*,5*b* comprises a first curvilinear surface 13 arranged at one end of the side tubular portion 2*a*,2*b* and a second curvilinear surface 14 provided on the tapered portion 3*a*,3*b*.

The first curvilinear surface 13 has a curvature substantially corresponding to that of the second curvilinear surface 14 so as to rotatably couple the tapered portion 3*a*,3*b* to the respective side tubular portion 2*a*,2*b*.

In detail, the tapered portion 3*a*,3*b* can take, with respect to the respective side tubular portion 2*a*,2*b* and thanks to the ball joint 5*a*,5*b*, a series of positions given by the combination of the rotation of the tapered portion around the axis X-X and by the inclination of the lying plane α defined by the support base 15 with respect to a vertical direction.

The support base 15 is the part of the tapered portion that is configured to rest on the inner wall 20,21 of the formwork.

In particular, the ball joint 5*a*,5*b* is configured to allow an inclination of the lying plane α of less than 45° with respect to a vertical direction.

Preferably, the ball joint 5*a*,5*b* is configured to allow an inclination of the lying plane α of less than or equal to 30° with respect to a vertical direction.

The Applicant considers that a greater inclination of the lying plane α with respect to a vertical direction would lead to problems when inserting the cross tie rod 7.

The central tubular portion 4 is hollow and its recess, with the spacer device 10 assembled, is in communication with the recesses of the side tubular portions 2*a*,2*b* to house the cross tie rod 7 therein.

The function of the spacer device 10 for formwork is, in fact, to protect the cross tie rod 7 during the setting of the concrete, thus preventing the latter from adhering to the cross tie rod 7.

Once the concrete has hardened, said cross tie rod 7 must be extracted.

The central tubular element 4 extends along its extension axis coinciding, with the spacer device 10 assembled, with the longitudinal axis X-X for a length greater than 7 cm, preferably for a length greater than 10 cm.

This spacer device 10 for formwork, as it is clear from the above description, has the following advantages:

- it allows its tapered portions to remain adherent to the inner walls of the formwork even in case of slight misalignments and/or mutual inclinations of the same walls;
- it is at least partially reusable by being able to extract the lateral tubular portions after the concrete has dried; the latter can, in fact, be reused for subsequent laying, while the central tubular portion remains drowned in the concrete;
- low and competitive cost;
- simplicity of construction combined with high reliability.

Several changes can be made to the embodiments described in detail, all anyhow remaining within the protection scope of the invention, defined by the following claims.

The invention claimed is:

1. A spacer device (10) for formwork of the type comprising two formwork panels arranged so that they face each other; each panel having an inner wall (20,21) and an outer wall, the inner wall being the one intended to contact the concrete, said spacer device comprising a hollow tubular body (2) extending around a longitudinal axis (X-X), said tubular body (2) being configured to house a cross tie rod (7), said spacer device comprising:

- two tapered portions (3*a*,3*b*) configured to rest on the inner walls (20,21) of the formwork;
- two side tubular portions (2*a*,2*b*);
- each side tubular portion (2*a*,2*b*) comprising an inner end including fastening means and an outer end configured to rotatably engage said tapered portion (3*a*,3*b*);
- said fastening means comprising a section-reduced portion (17) of said inner end of said side tubular portion and a plurality of radially projecting longitudinal ribs (9),
- said spacer device being characterised by a ball joint (5*a*,5*b*) formed at the outer end of the respective side tubular portion (2*a*,2*b*) to couple each tapered portion (3*a*,3*b*) with the respective side tubular portion (2*a*,2*b*),
- said ball joint (5*a*, 5*b*) being integral with the side tubular portion (2*a*,2*b*) and being placed in rotating engagement with the respective tapered portion (3*a*,3*b*).

2. The spacer device (10) for formwork according to claim 1, characterised in that each ball joint (5*a*,5*b*) comprises a first curvilinear surface (13) arranged at said outer end of said side tubular portion (2*a*,2*b*) and a second curvilinear surface (14) provided on the tapered portion (3*a*,3*b*); said first curvilinear surface (13) having a curvature substantially corresponding to that of said second curvilinear surface (14) so as to rotatably couple said tapered portion (3*a*,3*b*) with said side tubular portion (2*a*,2*b*).

3. The spacer device (10) for formwork according to claim 1, characterised in that said tubular body (2) comprises a central tubular portion (4) disposed between the inner ends of said two side tubular portions (2*a*,2*b*).

4. The spacer device (10) for formwork according to claim 2, characterised in that said tubular body (2) comprises a central tubular portion (4) disposed between the inner ends of said two side tubular portions (2*a*,2*b*).

5. The spacer device (10) for formwork according to claim 3, characterised in that said fastening means are shaped to removably couple said side tubular portion (2*a*,2*b*) to said central tubular portion (4).

6. The spacer device (10) for formwork according to claim 4, characterised in that said fastening means are shaped to removably couple said side tubular portion (2*a*,2*b*) to said central tubular portion (4).

7. The spacer device (10) for formwork according to claim 3, characterised in that said tapered portion (3*a*,3*b*) comprises a support base (15) adapted to define a lying plane ($\alpha$).

8. The pacer device (10) for formwork according to claim 4, characterised in that said tapered portion (3*a*,3*b*) comprises a support base (15) adapted to define a lying plane ($\alpha$).

9. The spacer device (10) for formwork according to claim 7, characterised in that said ball joint (5*a*,5*b*) is configured to allow an inclination of said lying plane (a) of less than 45° with respect to a vertical direction.

10. The spacer device (10) for formwork according to claim 2, characterised in that said side tubular portions (2*a*,2*b*) have substantially equal extension along said longitudinal axis (X-X).

11. The spacer device (10) for formwork according to claim 3, characterised in that said side tubular portions (2*a*,2*b*) have substantially equal extension along said longitudinal axis (X-X).

12. The spacer device (10) for formwork according to claim 1, characterised in that each tapered portion (3*a*,3*b*) is arranged outwardly of said ball joint (5*a*,5*b*) while each side tubular portion (2*a*,2*b*) is arranged inwardly of said ball joint (5*a*,5*b*).

13. The spacer device (10) for formwork according to claim 2, characterised in that each tapered portion (3*a*,3*b*) is arranged outwardly of said ball joint (5*a*,5*b*) while each side tubular portion (2*a*,2*b*) is arranged inwardly of said ball joint (5*a*,5*b*).

14. The spacer device (10) for formwork according to claim 1, characterised in that said fastening means comprise longitudinal cuts (11) arranged laterally to said longitudinal ribs (9).

15. The spacer device (10) for formwork according to claim 14, characterised in that said longitudinal rib (9) has a height, measured in a radial direction, which is variable along its extension.

16. The spacer device (10) for formwork according to claim 1, characterised in that said side tubular portions (2*a*,2*b*) have substantially equal extension along said longitudinal axis (X-X).

* * * * *